US005857623A

United States Patent [19]

Miller et al.

[11] Patent Number: 5,857,623

[45] Date of Patent: Jan. 12, 1999

[54] DEVICE AND METHOD TO PROVIDE STABILIZED DELIVERY OF PRESSURIZED LIQUID

[76] Inventors: Raymond G. Miller, 33 S. Westcott Rd., Schenectady, N.Y. 12306-9408; Raymond A. Feurstein; Eric J. Feurstein, both of 1927 Euclid Ave., Schenectady, N.Y. 12306

[21] Appl. No.: 708,377

[22] Filed: Sep. 4, 1996

[51] Int. Cl.[6] ..... B05B 3/06

[52] U.S. Cl. ..... 239/252; 239/558; 239/560

[58] Field of Search ..... 239/251, 252, 239/DIG. 3, 560, 558, 556; 769/70, 36

[56] References Cited

U.S. PATENT DOCUMENTS

| | | | |
|---|---|---|---|
| 1,151,334 | 8/1915 | Bell | 239/285 |
| 2,607,625 | 8/1952 | Salmonese | 239/251 X |
| 2,813,753 | 11/1957 | Roberts | 169/70 X |
| 2,857,005 | 10/1958 | Medlock | 169/70 X |
| 2,930,531 | 3/1960 | Kennedy | 239/251 X |
| 3,120,346 | 2/1964 | Willhoite | 239/251 X |
| 3,125,297 | 3/1964 | Copeland et al. | 239/251 X |
| 3,550,861 | 12/1970 | Teson | 239/546 |
| 3,814,330 | 6/1974 | Masters | 239/558 |
| 3,941,314 | 3/1976 | Moss et al. | 239/553.3 |
| 4,216,910 | 8/1980 | Kimbrough | 239/DIG. 13 X |
| 4,219,084 | 8/1980 | Gray et al. | 169/70 X |
| 4,699,163 | 10/1987 | Baziuk | 134/167 C |
| 4,802,535 | 2/1989 | Bakke | 169/70 |
| 4,821,961 | 4/1989 | Shook | 239/253 |

FOREIGN PATENT DOCUMENTS

| | | | |
|---|---|---|---|
| 936610 | 11/1946 | France | 231/251 |

*Primary Examiner*—Kevin Weldon

[57] ABSTRACT

A nozzle body and coupler bearing assembly for discharging a liquid material. The nozzle body consists of approximately thirty-two serially and concentrically arranged ports which receives liquid from an attached hose under high pressures. The various points of placement of the ports, combined with the rotation produce a balanced and stabilized effect on the rotating nozzle assembly which allows the nozzle assembly to be delivered to a target area, and while in operation, have the ability to be left unattended by fire-fighting personnel. The wild and natural whipping action exhibited from a fire hose under high operating pressures is nullified with the present nozzle. The body of the nozzle is a hollow paraboloid attached to a coupler bearing assembly. The nozzle body is made from a resilient and durable material with concavo-convex surfaces with a plurality of ports emitting liquid in a radial "Dandelion puff" pattern. Three of the four port groups have approximate angles which are arranged tangentially and acutely to the axis of rotation and flow. The fourth group has an approximate angle which is arranged acutely to the horizontal plane of the longitudinal axis of rotation and flow. The nozzle assembly may be transported, delivered, placed, propelled, launched, carried, or otherwise put in any mode, means, or fashion to a target to which a liquid needs to be provided or dispersed.

21 Claims, 9 Drawing Sheets

DEVICE AND METHOD TO PROVIDE STABILIZED DELIVERY OF PRESSURIZED LIQUID

BACKGROUND OF THE INVENTION

The current and various styles of prior art nozzles, whether steady stream or spray, are subjected to the same vector and spiraling effects of a liquid under pressure passing through the hose and through the nozzle head. There is also the vector force of the projecting liquid and the resultant effect of this force which causes the tendency of an unsecured and uncontrolled hose under high pressure to be whipped about wildly and uncontrollable. This effect exhibits the physical principles of action-reaction which is well recognized and as a consequence, dictates that fire-fighting regulations and insurance liability requirements mandate that one, two, or three men operate a hose under high pressures. The men act in concert to stabilize the hose's tendency to whip about thus being a counter-force to the vector forces and the spiraling effect going on within and without the hose itself. A drawback of these prior art nozzles is that multiple valuable men are encumbered to a single task and that if the hose is loosed from the men controlling it, becomes in itself a lethal device until it is brought under control or shutdown.

An additional problem of prior art nozzles attached to a hose under high operating pressures is the ability to deliver the hose and nozzle head to the area of need. In the case of fires, personnel are deployed both to attend and control the hose and also to move the hose into hazardous areas to allow the hose to deliver the intended liquid to a fire or targeted area. This endangers the personnel by directly putting them into harm's way. As a consequence many lives are lost, persons injured, and insurance liabilities are high.

Another problem with existing prior art nozzles is their ability to penetrate a barrier. Prior art nozzles to this point need to be manned or engaged by personnel to aid or force the nozzle through an intended barrier to deliver a specified liquid to a target. The current practice for this method again endangers the operating personnel by requiring them to be in close proximity to the danger area. As stated before, a consequence is that many lives are lost, persons injured, and insurance liabilities are high.

OBJECTS OF THE INVENTION

It is thus a primary object of the present invention to provide a nozzle which can satisfactorily deliver a liquid material from an attached hose under high pressures to a target area; where said nozzle can be placed or delivered to the target; and that said nozzle can be under full operation without personnel in attendance or caused to be put unnecessarily in danger. It is also an object of the present invention, that given that, the nozzle assembly being under full or partial operation, that any personnel in attendance are not necessary to maintain control of the nozzle body after it has been deployed and put into operation.

It is another object of this invention that the nozzle may be transported, delivered, placed, propelled, launched, carried, or otherwise put in any mode, means, or fashion to a target by means of a delivery mechanism or system.

It is another object of this invention to provide a nozzle, as above, which includes outlets, ports, or nozzlettes spraying radially, tangentially, and acutely to the longitudinal axis of the nozzle body to produce a rotation, a gyroscopic effect, a centripetal stabilizing effect, and a radial spray to deliver a liquid material to a target. These and other objects of the present invention, which will become apparent from the following description are accomplished through the means and are herein described and claimed.

SUMMARY OF THE INVENTION

A generally paraboloid nozzle body containing acutely angled ports which are arranged in a concentric pattern through a concavo-convex surface. The acutely angled forward ports are arranged forming a plurality of angled holes set at approximate acute angles to the axis of rotation. The middle pair of ports are set tangentially to the axis of rotation and are arranged forming a plurality of concentric ports. The rear-most arrangement of ports is offset at an acute angle to and aligned to the horizontal plane of the axis of rotation of said nozzle. The nozzle is attached at the rear to a coupler bearing assembly and then to a hose by means of a hose connector. The convex outer surface is provided with forward ports which emit streams of liquid material substantially and acutely to the longitudinal axis of flow; whereas a middle pair of ports emit streams of liquid material substantially and tangentially to the longitudinal axis of flow; and whereas rearward ports emit streams of liquid material substantially and acutely from the horizontal plane of the axis of flow. The forward ports emit a spray which, when under pressure, causes a gyroscopic effect on said nozzle body during operation. The pair of middle ports emits a spray which cause a centripetal stabilizing force; and the rearward ports emits a spray which propel the nozzle body, in conjunction with the coupler bearing assembly, in a clockwise rotation and also contributes to a stabilizing effect in the nozzle assembly but differ from the forward ports in both purpose and alignment from the axis of flow; thus a thrust-stabilizing effect.

The plurality of forward ports are arranged in concentric patterns at differing acute and tangential angles to the axis of rotation and along a convex outer surface and an interior concave surface. This results in a paraboloid body with concavo-convex surfaces through which a plurality of acutely and tangentially angled ports are arranged in concentric patterns. Each concentric group being thus angled differently and independent of the other angled groups. All concentrically angled port groups, except the rearward port group, are positioned acutely to the axis of rotation and flow. The rearward port group, albeit acutely angled and concentric, is positioned and oriented to the horizontal plane of the axis of rotation.

The nozzle body is attached to a coupler bearing assembly composed of a gasket, bearing housing with a steel dowel pin, a washer with a lock pin, a dry thrust bearing, a retaining washer, a spring clip, a shaft, and a gasket.

The nozzle assembly comprising the nozzle body and the coupler bearing assembly may be attached to a launching or delivery device whereby when said nozzle assembly is attached to a hose under high pressures, the assembly and hose may be delivered to a target area where said liquid may be dispersed. This resulting system and method to deliver and disperse a liquid material to a target area enables the nozzle assembly attached to a hose under high pressures to be left unmanned and unattended.

DETAILED DESCRIPTION OF THE PREFERRED EMBODIMENT

Figure 1A:
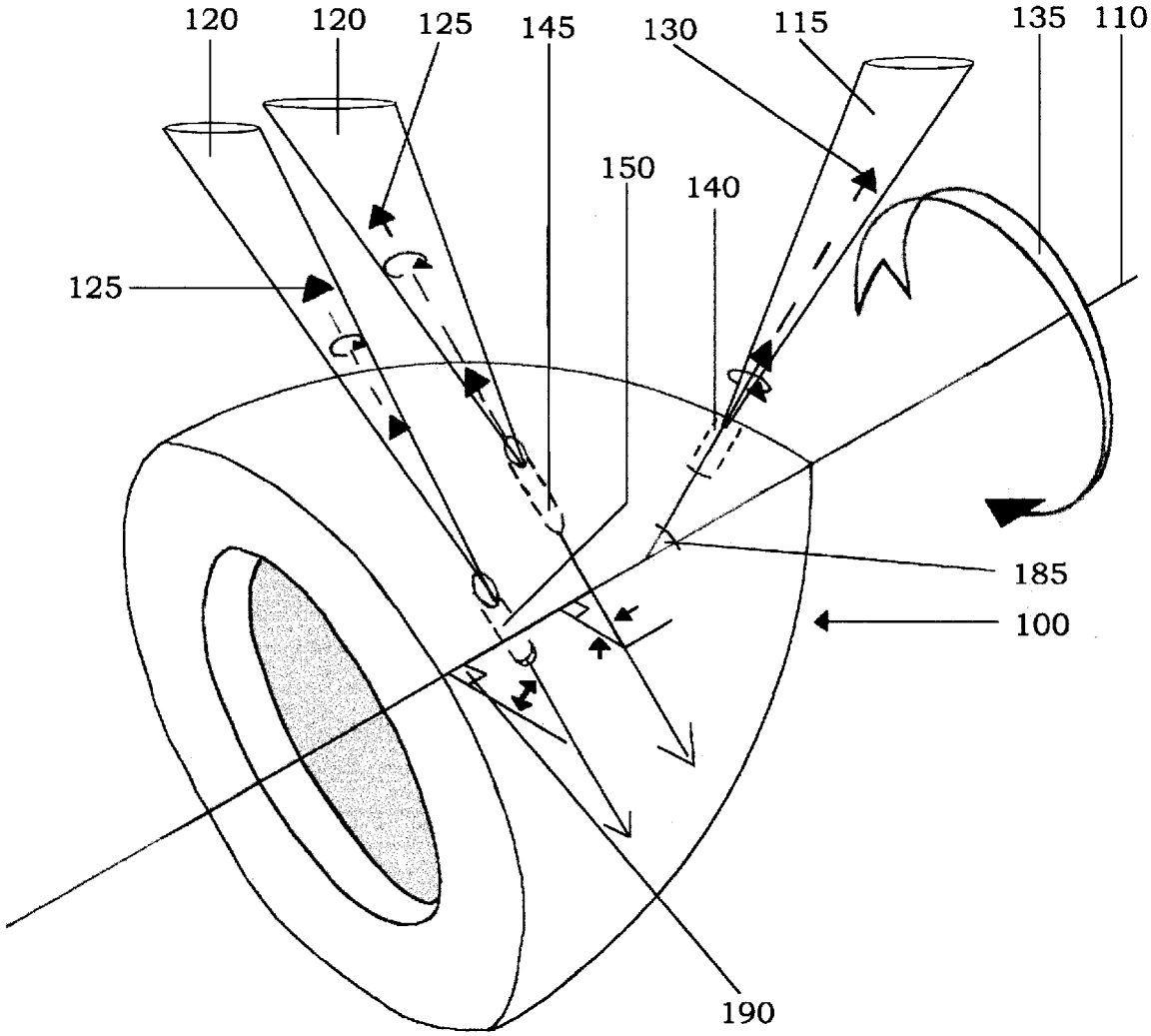
FIG. 1*a* is solid view of the nozzle body of the present invention depicting the various angles of the forward and middle ports and the geometrical arrangements of the various axis and forces as they relate to the present invention.

FIG. 1*a* depicts the forward and middle ports of this invention. When attached to a coupler bearing assembly enabling rotation about a longitudinal geometric axis of rotation 110, and in turn to a hose providing pressurized liquid, as will be described in later figures, a nozzle body 100 is enabled to rotate about said longitudinal geometric axis of rotation 110 in a clockwise direction 135. Forward gyroscopic ports, nozzlettes, or holes 140; hereinafter referred to as ports; and a pair of middle stabilizing ports 145 and 150 are positioned radially and concentrically about the longitudinal geometric axis 110; hereinafter referred to as axis; and wherein said forward gyroscopic ports 140 are also positioned at an approximate acute angle 185 to the axis 110. FIG. 1*a* depicts one of each of such ports; later figures will depict the entire set of ports. As a fluid enters the nozzle body 100 it is emitted through the ports 140, 145 and 150. The forward gyroscopic ports 140 emit a spray of liquid with a forward direction generally depicted in the drawings by the number 130; wherein said liquid produces a gyroscopic force depicted as the vector space cone 115 as shown in FIGS. 1*a* and, later, 2*b*.

The pair of middle stabilizing ports 145 and 150 are positioned radially and concentrically about the nozzle body 100 and both are positioned at an approximate right angle 190 to the axis 110. As fluid enters the nozzle body 100, it is emitted through the middle stabilizing ports 145, and 150. The middle stabilizing ports 145 and 150 emit a spray of liquid in a radial direction generally depicted in the drawings by the numbers 125; wherein said liquid produces a centripetal stabilizing force depicted as the tangential vector space cones 120 as shown in FIGS. 1*a* and 2*b*.

Figure 1B:
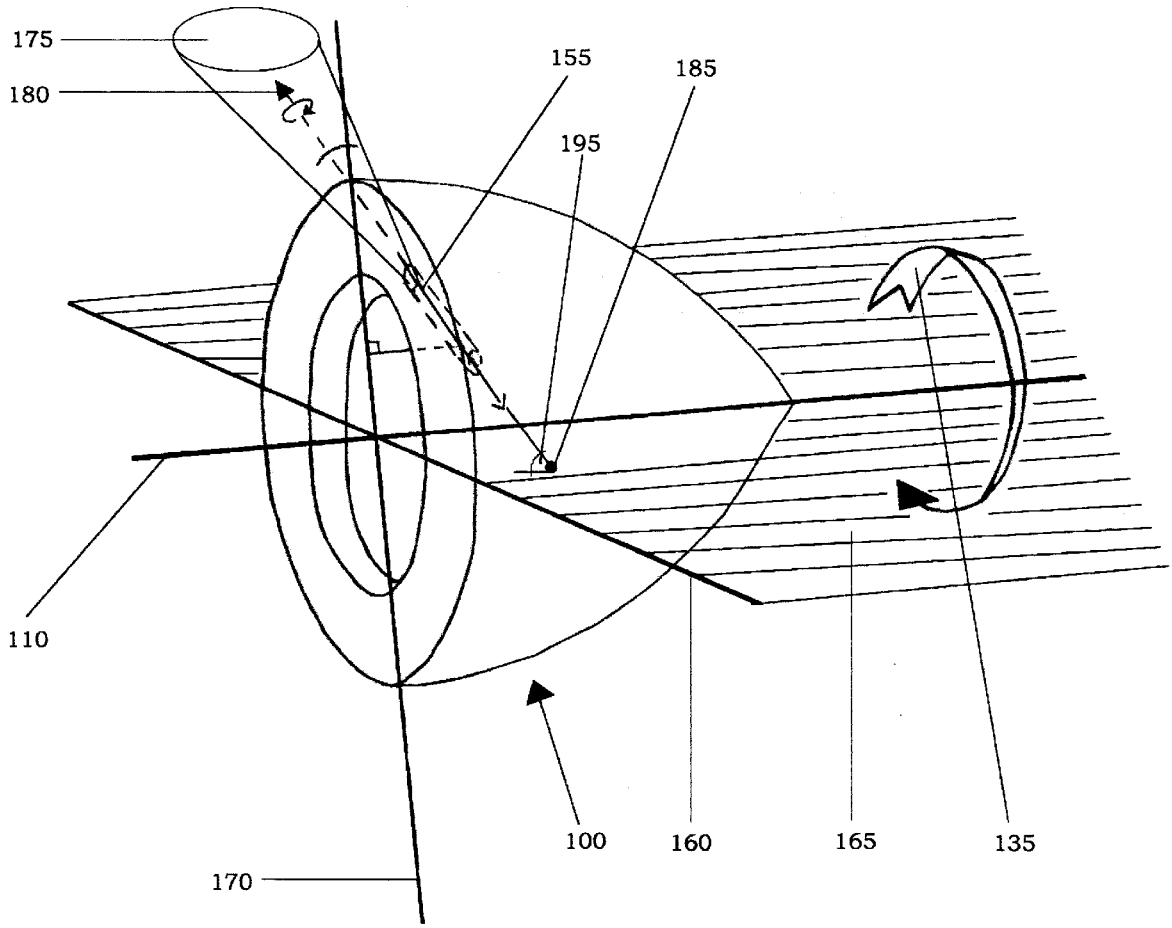
FIG. 1*b* is solid view of the nozzle body of the present invention depicting the angle of the rearward ports and the geometrical arrangements of the various axis and forces as they relate to the present invention.
Figure 2A:
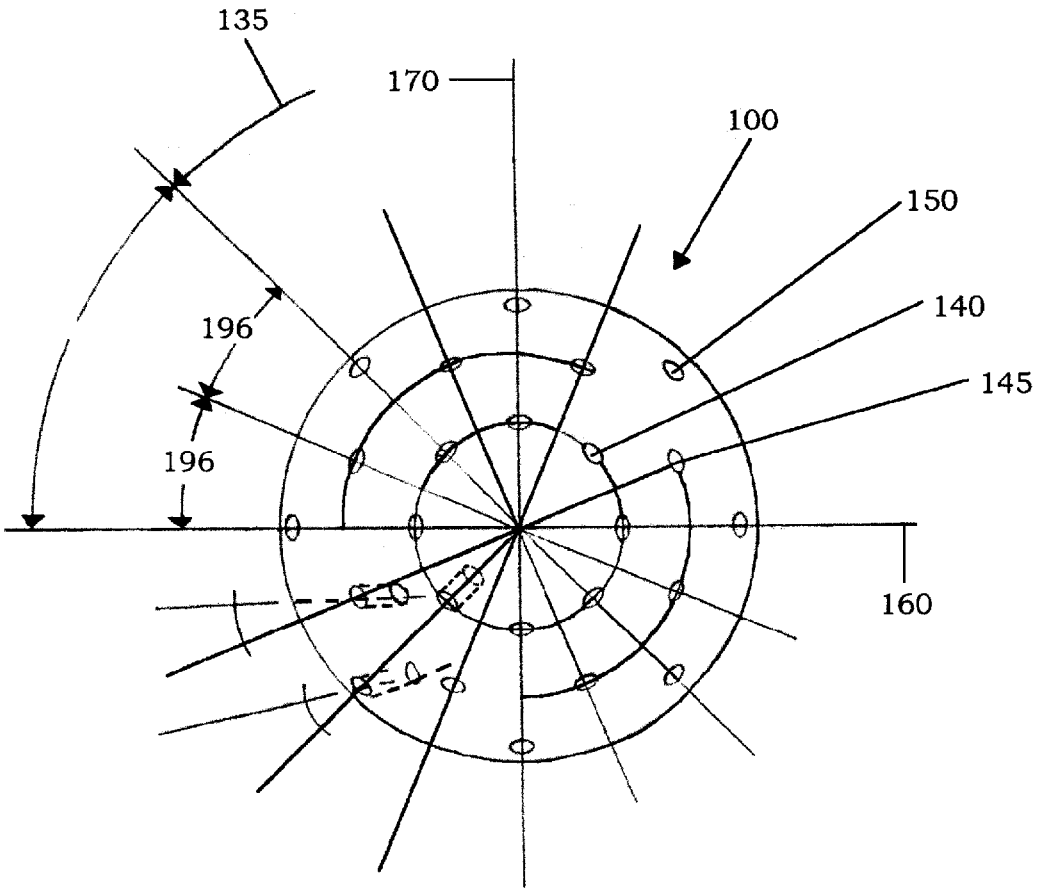
FIG. 2*a* is an overhead (top) view of the nozzle of the present invention depicted showing the radial concentric array of the ports in relation to the axis of rotation.

FIG. 1*b* depicts one of a number of rearward thrust-stabilizing ports 155, positioned radially and concentrically about the nozzle body 100. These are positioned at an approximate acute angle 195 to the horizontal plane 160 which passes though the longitudinal axis 110. As fluid enters the nozzle body 100 it is emitted through the rearward thrust-stabilizing ports 155. The rearward thrust-stabilizing ports 155 emit a spray of liquid with a radial direction generally depicted in the drawings by the number 180; wherein said liquid produces a thrust-stabilizing force depicted as the vector space cone 175; wherein said thrust-stabilizing force 175 cancels the net translational gyroscopic force produced by the forward gyroscopic ports 140. Precession is the natural tendency of the gyroscopic influences, however, since the rearward force 175 originates from an offset position 185 on the horizontal plane 160 to the axis 110, the precessional tendency is nullified. Thus, considering at this point all of the right-angle influences, tangential forces, moments of inertia, and gyroscopic forces of a free-rotating solid body; the net force translated is zero producing a torque-free rotation. The acute approximate angle 195 of the rearward ports 155 also produces a thrust force 175 in a direction generally indicated by the number 180. FIG. 2*a* depicts a front (top) view of the nozzle body. The ports 140, 145, 150, and 155 are generally positioned in sets, in a concentric pattern about the center axis that is 110 in FIGS. 1*a* and 1*b*, forming a plurality of ports as shown in FIG. 2*a*. A horizontal axis 160 and vertical axis 170 are shown to give proper reference and orientation. The ports 140, 145, 150, and 155 are offset successively from each other at smaller approximate acute angles 196. Dotted line cylinders are used for one member of each set of ports to depict the approximate angular orientation of each set of ports.

Figure 2B:
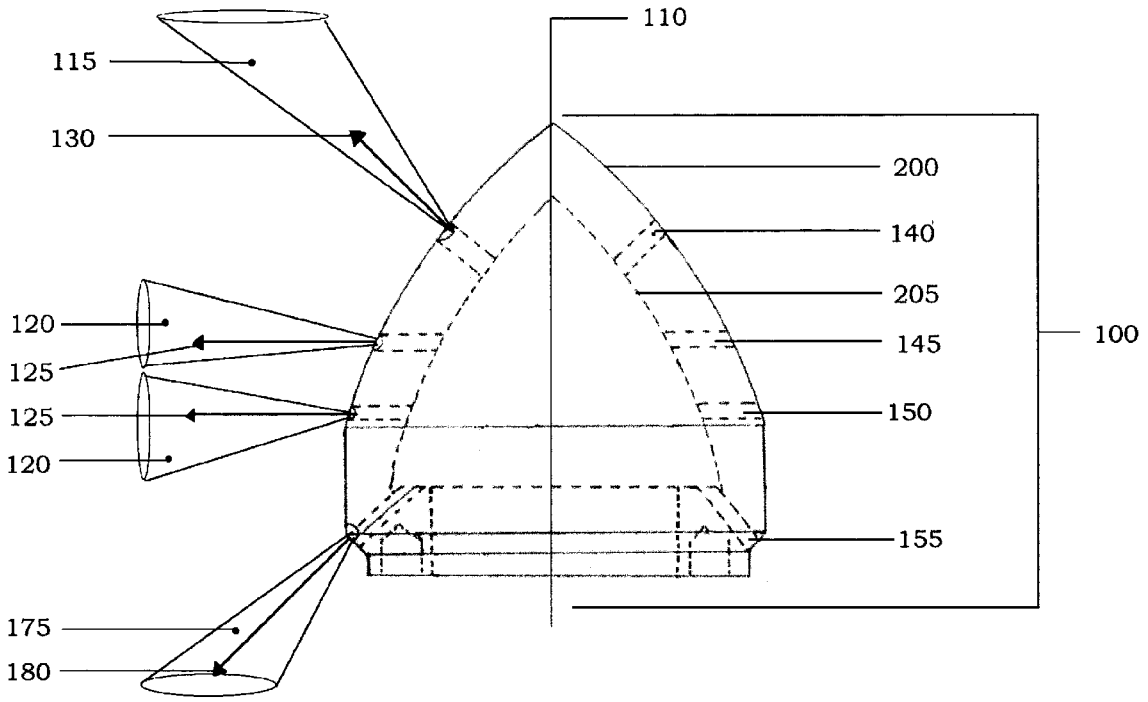
FIG. 2*b* is a cutaway section of the present invention depicted showing the approximate angular position of the nozzelettes in relation to the axis of rotation.
Figure 2C:
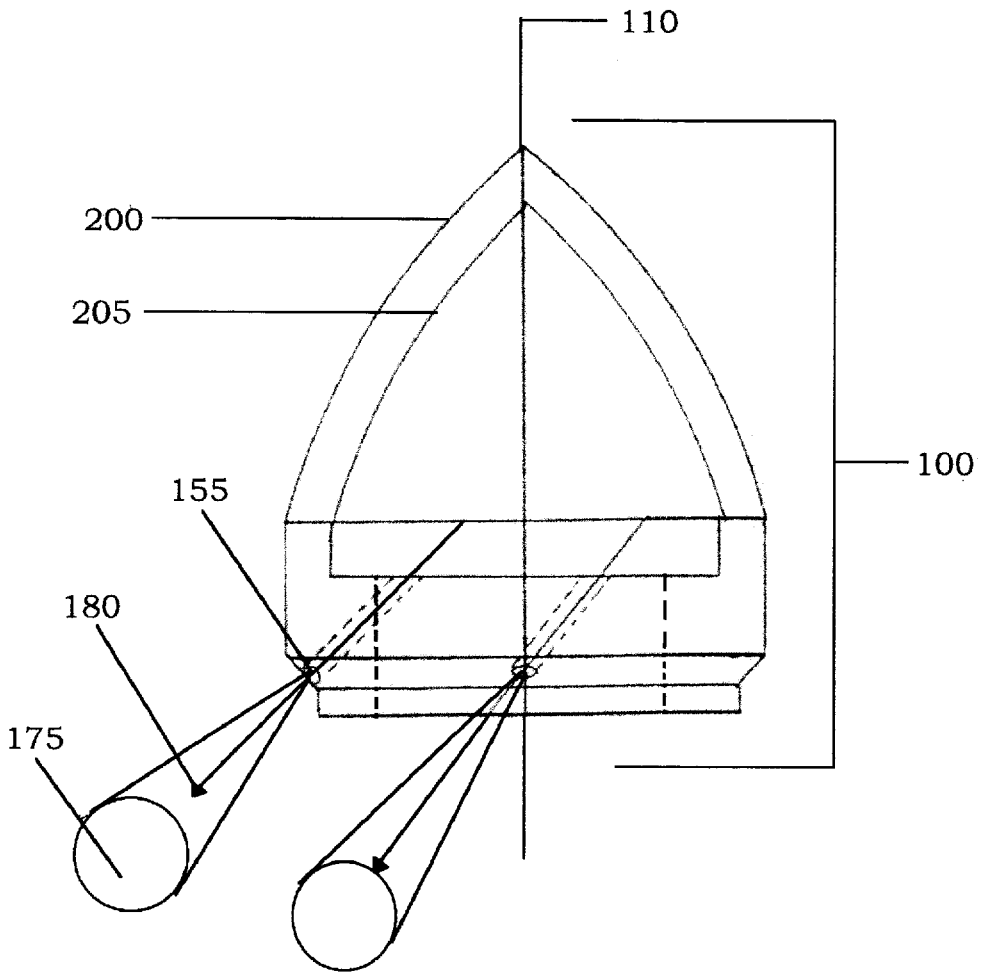
FIG. 2*c* is a cutaway section of the present invention depicted showing the approximate angular position of the rearward nozzelettes in relation to the axis of rotation.
Figure 2D:
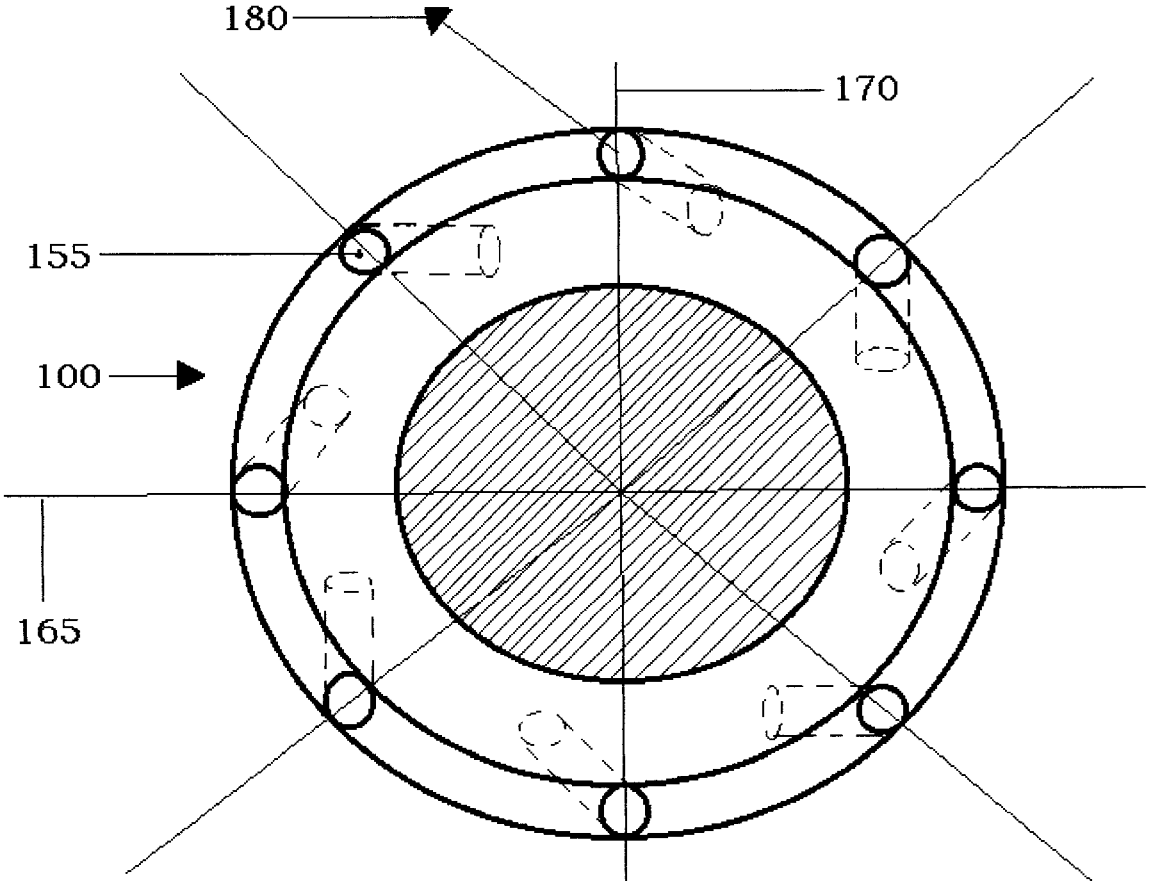
FIG. 2*d* is a bottom (rear) view of the present invention depicted showing the approximate angular position of the rearward nozzelettes in relation to the axis of rotation.
Figure 3:
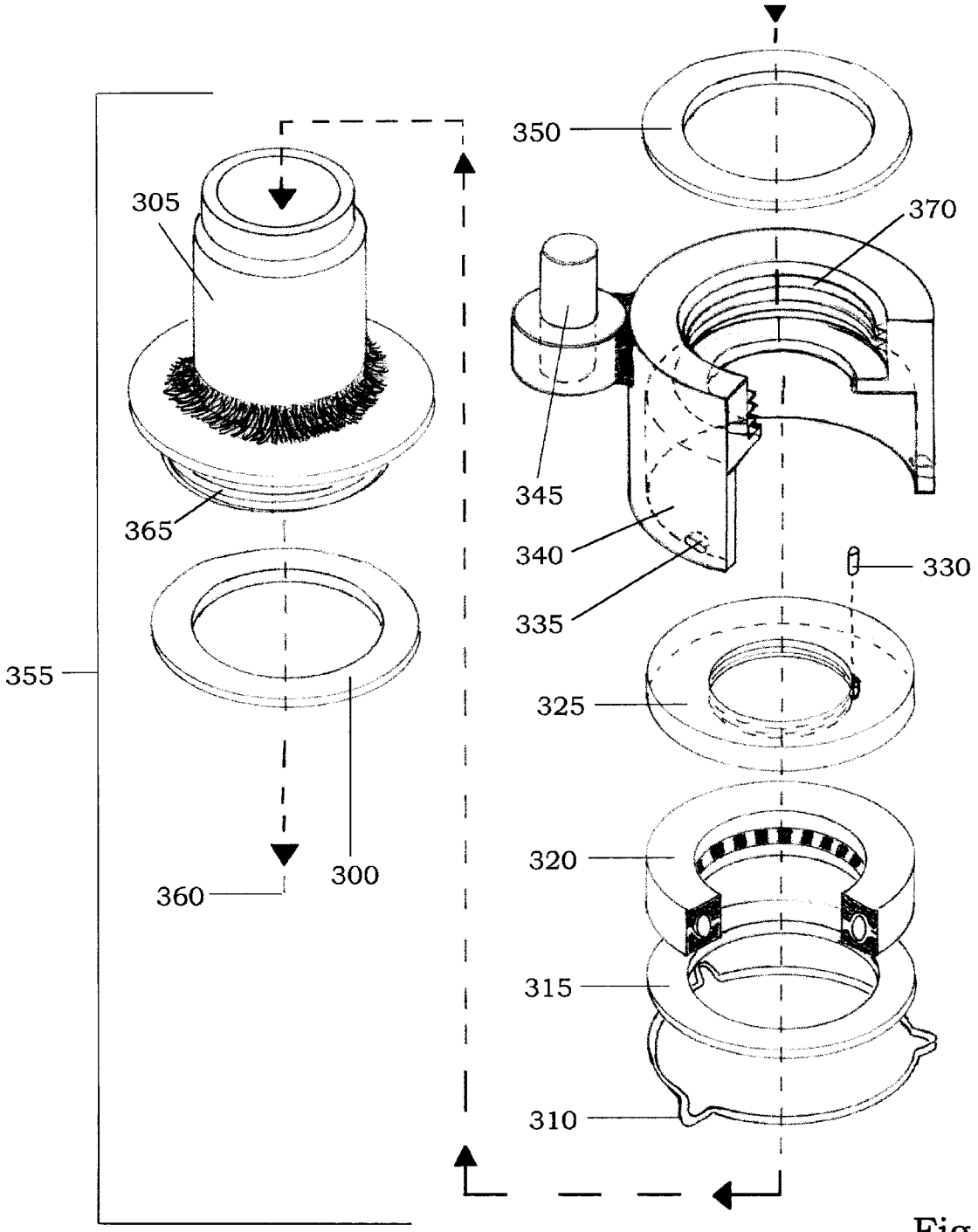
FIG. 3 is an exploded view of the coupler bearing assembly of the present invention showing the coupler bearing components in order of assembly.
Figure 4:
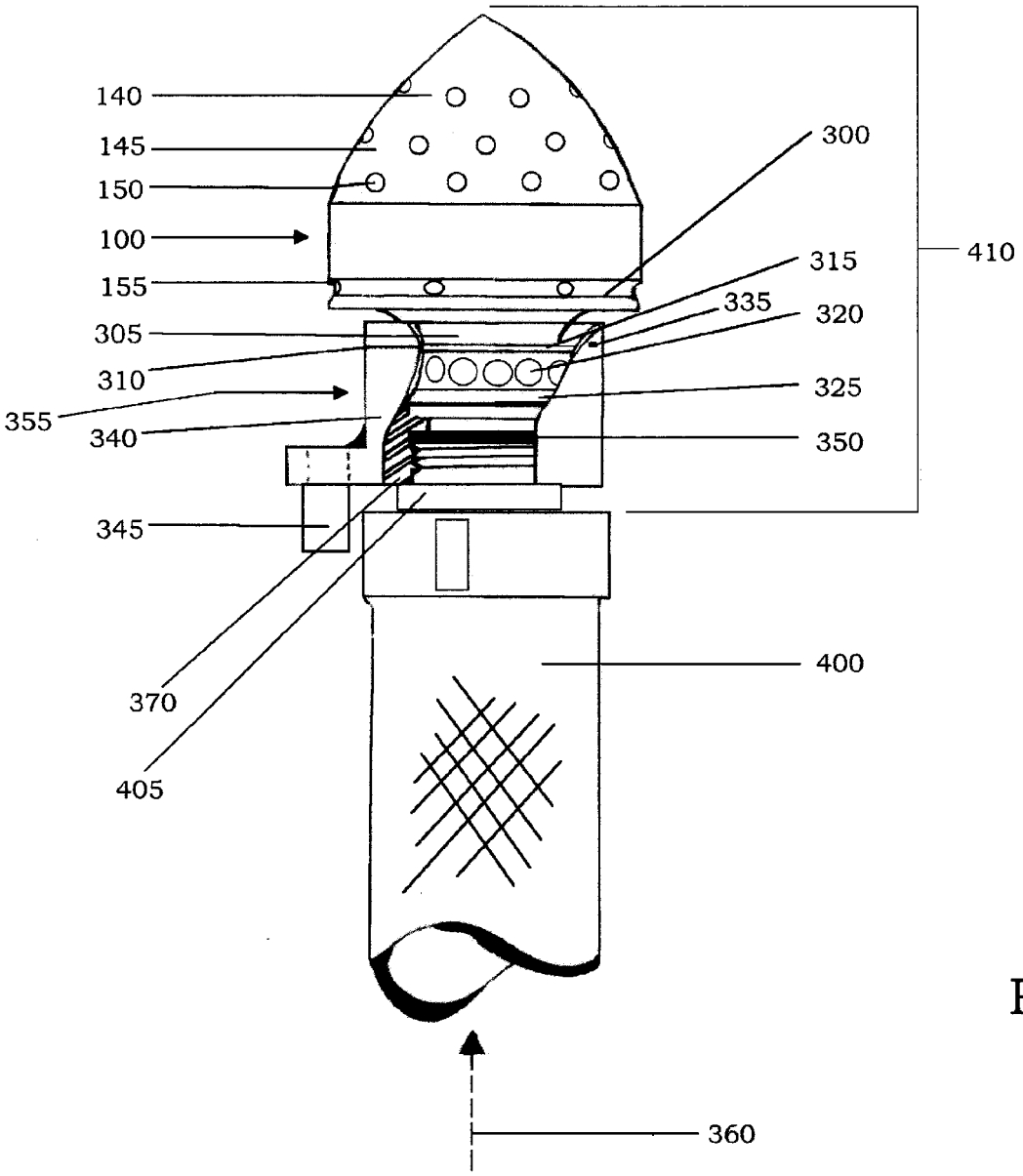
FIG. 4 is a sectional view of the nozzle of the present invention depicted in the pre-operative state of the nozzle and coupler bearing assembly attached to a hose and in a state of preparation to be delivered to a target.

As shown in FIGS. 2*b* and 2*c*, depicting a side view of the nozzle body 100, the paraboloid nozzle body 100 is hollow and depicted with characteristic outer convex surface 200 and interior concave surface 205 thus producing the concavo-convex surface as shown in these figures. The paraboloid nozzle body 100 may be constructed from any material which will allow the embodiment of the physics principles to interact to produce the desired effect of a stabilized delivery. The convex outer surface 200 converges at the top of said nozzle body 100 forming a point; whereby barrier penetration would be facilitated. Employing a hard, dense, and durable material in the construction will help prolong its shelf-life and provide the nozzle with sufficient moments of inertia. Dotted line cylinders are again used to depict the approximate angular orientation of the ports from the side view. The directions of liquid emission are again shown by 125, 130 and 180, and the vector space cones are again shown by 115, 120 and 175. FIG. 2*d* is a bottom (rear) view of the nozzle body 100, and depicts from this view the angular orientation of the rearward ports 155, and the fluid flow direction 180. The coupler bearing assembly generally indicated by the number 355 in the drawings and shown in FIG. 3 in an exploded view is comprised of a paper gasket 300 which is placed over the threaded portion 365 of the shaft 305; wherein a spring clip 310 is then placed over the main section of the shaft 305; wherein a retaining washer 315 is placed atop of the spring clip 310; wherein a dry thrust bearing 320 is positioned atop of the retaining washer 315; wherein a thrust washer 325 is placed atop of the dry thrust bearing 320 and held in place by a pin 330. This assemblage is inserted into the bearing housing 340; whereby the spring clip 310 is secured into the slots 335 which are within the bearing housing 340. Finally, an additional gasket 350 is placed within threaded portion of the bearing housing 340. FIG. 4 depicts the entire bearing housing assembly 355 as attached to the nozzle body 100. The combination of the nozzle body 100 and the coupler bearing assembly 355 creates the entire nozzle assembly 410. The designated liquid travels in the direction of flow as indicated by the number 360 in the drawings as shown in FIGS. 3 and 4. The dowel pin 345 plays a role in the securing and launching of the entire assembly, as will be discussed in connection with FIG. 5. As shown in FIG. 4, the rear of the nozzle assembly 410, and more specifically the coupler bearing housing 340 is threaded as depicted in the drawings by the number 370 and shown in FIG. 3 which receives the standard hose connector 405 as shown in FIG. 4. The threaded portion 370 of the bearing coupler assembly 355; being attached to the nozzle body 100 is screwed onto the standard hose connector 405. The hose 400 as shown in FIG. 4 is supplied with a liquid under high pressures, which enters the entire nozzle assembly 410, more specifically the nozzle body 100 and is emitted through the plurality of concentric ports 140, 145, 150, and 155. It is to be observed that liquid, as herein defined and envisioned, refers to any liquid, water, foam, liquid-foam combination, or other material which is to be distributed by said nozzle assembly 410. The hose 400 as herein defined and envisioned, refers to any hose, pipe, conduit, or method of supplying or conveying a liquid or the like from a source to said nozzle assembly 410.

Figure 5:
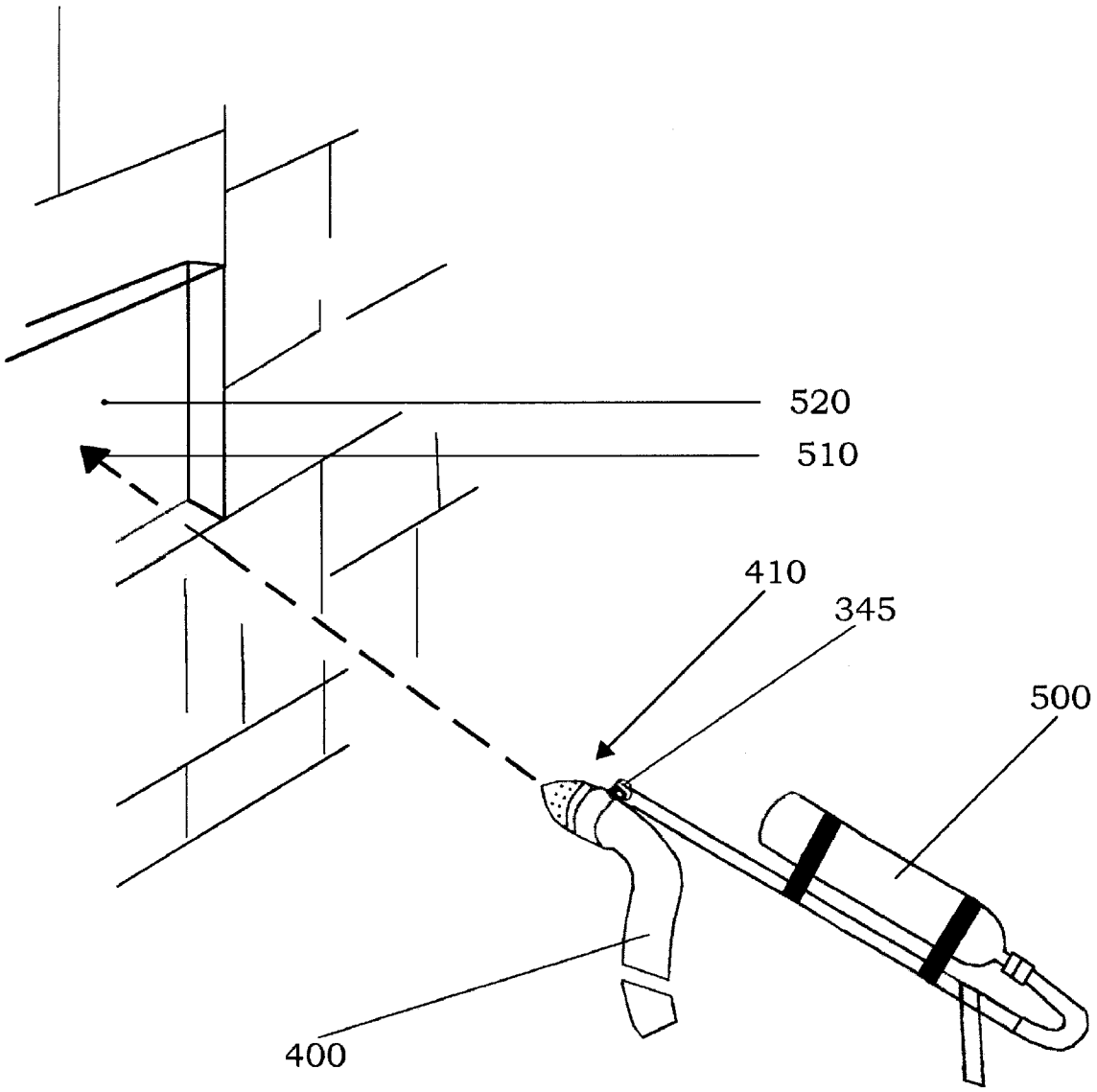
FIG. 5 is an angled view of the nozzle assembly of the present invention depicted in the pre-operative state of the nozzle and coupler bearing assembly attached to a hose and in a state of preparation and being secured in a launching device which is being directed at an intended target.

As shown in FIG. 5, the entire nozzle assembly 410 is then attached to a delivery system 500; wherein delivery system is defined and envisioned to encompass any means or mode of transporting, delivering, placing, propelling, launching, carrying, or otherwise putting the nozzle assembly 410 near or at the intended target location; wherein launching is defined and envisioned to encompass any means or mode to transport, deliver, place, propel, launch, carry, or otherwise move the nozzle assembly 410 in a general direction 510 to its intended target 520. In this delivery embodiment, the dowel pin 345 is attached to a delivery system 500 as shown in the FIG. 5. The spray of the liquid, as the liquid enters the nozzle body 100 and is emitted through the ports 140, 145, 150, and 155; is radiated away from the nozzle body 100 in a dandelion puff pattern proportional to the applied pressures within the hose 400.

Once the entire nozzle assembly 410 has been delivered to a target 520, the liquid is released in the spray pattern as described and, as described earlier, the various vector forces are nullified, thereby allowing free nozzle body rotation and requiring no personnel in controlling attendance. This feature relieves the operator from having to be in proximity to a hazardous area thus solving two of the problems of prior art nozzles. This solves the earlier described problem of having to have one or more operating and controlling personnel in attendance to operate and control a prior art nozzle attached to a hose under high pressures because the prior art nozzle thus attached will whip about wildly and itself become a lethal object. It also solves the earlier described problem of a prior art nozzle thus attached to a hose under high pressures whereby the nozzle and hose whip about wildly and uncontrolled. The nozzle of the present invention eliminates the natural whipping tendency and stabilizes the nozzle as attached to the hose under high liquid pressures. The paraboloid body, with its pointed end, being made a projectile and being attached to a hose under high pressures and being launched at an intended target has the ability to penetrate a barrier unassisted by an operator once launched thus solving another problem of prior art nozzles. While the above description pertains to the preferred embodiment of the invention, numerous variations, changes and substitutions may occur to those of ordinary skill in the art without novel or non-obvious departure from what is claimed herein. For example, realignment on the nozzle body 100 of port placement, orientation, position, etc., which preserve the cancellation of vector forces would be constituted as obvious enhancements. So too, would be changes and variations in the material used to construct the nozzle, or in its shape, so long as the basic cancellation of forces and ability to launch to a target area is preserved. The coupler bearing assembly 355 disclosed herein is one of a limitless variety of such assemblies that can be conceived by a person of ordinary skill in the art to permit attachment of the nozzle body 100 to a hose 400 while allowing it to freely rotate about the axis of rotation 110 described herein, and any of these variations is squarely contemplated and foreseen within the present disclosure.

Similarly, as stated above, many different means can be used for launching the assembly to its target destination, which would be obvious to someone of ordinary skill. Similarly, as noted, many different types of liquid and hose can be used in connection with this invention, and this too would be obvious to someone of ordinary skill.

Finally, while fire-fighting is singularly the most important application of this invention, due to the many lives that can be saved by eliminating the need for humans to physically transport a fire hose into a dangerous area, it is obvious that this invention can similarly be used in any setting where it is desired to deliver liquid under pressure via a hose to some destination, wherein it is also desired to achieve a cancellation of vector forces enabling the hose to remain stable and eliminating the need for human attendance to provide such stability or control. Notwithstanding, human intervention or control of a balanced and stabilized nozzle, either directly or remotely, could be accomplished and envisioned with this invention, and this too would be obvious to someone of ordinary skill.

It should thus be evident that a nozzle constructed and operated as described herein can deliver the required liquids to a target 520 in a safe and efficient manner thus accomplishing the object of the invention, and otherwise substantially improving the nozzle art.

We claim:

1. A combination nozzle body and coupling apparatus for stabilizing a delivery opening of a hose while said hose delivers a flow of liquid under pressure to a delivery location, comprising:

a nozzle body further comprising a plurality of nozzle ports enabling said liquid to pass through said nozzle body and be sprayed to said delivery location; and rotational coupling bearing means coupling said nozzle body to said hose and enabling said nozzle body to rotate about a geometric axis of rotation running through, parallel to, and oriented in the same direction as, the liquid flow; said nozzle ports further comprising:

rotation-inducing and centripetally-stabilizing nozzle port means causing said nozzle body to rotate about said axis of rotation, and further causing a centripetal stabilizing force to be applied to the rotation of said nozzle body, inward toward said axis of rotation, in reaction to the flow of said liquid out of said rotation-inducing and centripetally-stabilizing nozzle port means, thereby substantially cancelling centrifugal forces generated by said liquid flow out of said rotation-inducing and centripetally-stabilizing nozzle port means;

thrust-inducing nozzle port means causing a rearward thrusting force to be applied to said nozzle body in reaction to the flow of liquid out of said thrust-inducing nozzle port means; and thrust-cancelling nozzle port means causing a forward thrusting force to be applied to said nozzle body in reaction to the flow of liquid out of said thrust-cancelling nozzle port means, with such magnitude so as to substantially cancel said rearward thrusting force; wherein said thrust-inducing nozzle port means further provides gyroscopic precession cancellation means for opposing and substantially cancelling gyroscopic precession induced by the rotation of said nozzle body; whereby all of the physical thrust, centrifugal and gyroscopic precessional forces due to the passage of said liquid through said hose and nozzle body substantially cancel one another, resulting in no net translational, centrifugal and gyroscopic precessional forces acting upon the nozzle body.

2. The apparatus of claim 1, wherein said liquid is delivered to said delivery location by aiming said nozzle body at said delivery location over a distance from said delivery location.

3. The apparatus of claim 1, wherein said liquid is delivered to said delivery location using launching means to launch said nozzle body and said hose attached thereto to said delivery location.

4. The apparatus of claim 1 wherein said hose is a standard fire hose, and wherein said liquid is delivered to the location of, and for the purpose of extinguishing, a fire.

5. The apparatus of claim 1, wherein said nozzle body comprises a paraboloid shape and is made from a material that is hard and durable to prolong useful life, that is sufficiently dense to provide a suitable moment of inertia, and that suitably enables said liquid to be emitted from said ports established on said nozzle body.

6. The apparatus of claim 1, wherein:

said thrust-inducing nozzle port means are positioned upon the nozzle body nearest a forward region of said nozzle body and are substantially-equally spaced along at least one forward circumferential curve concentric to said axis of rotation; are oriented at an acute angle of approximately 30 degrees through said nozzle body relative to the orientation of said axis of rotation, thereby causing said rearward thrusting force; and when projected onto a plane of rotation normal to the axis of rotation, are further oriented at an angle of approximately zero degrees with respect to geometric radii originating at the axis of rotation and extending radially-outward through said plane of rotation, thereby opposing and substantially cancelling said gyroscopic precession; wherein said rotation-inducing and centripetally-stabilizing nozzle port means are positioned approximately upon a middle region of the nozzle body and are substantially-equally spaced along at least one middle circumferential curve concentric to said axis of rotation; are oriented at an angle of approximately 90 degrees through said nozzle body relative to the orientation of said axis of rotation thereby not substantially contributing a net thrust along said axis of rotation; and when projected onto a plane of rotation normal to the axis of rotation, are further oriented at a substantially non-normal angle with respect to geometric radii originating at the axis of rotation and extending radially-outward through said plane of rotation, causing said nozzle to rotate about the axis of rotation while causing said centrifugal forces to be substantially cancelled by virtue of the substantially-equal spacing of said ports along said at least one middle circumferential curve; wherein said thrust-cancelling nozzle port means are positioned upon the nozzle body nearest a rear region of said nozzle body and are substantially-equally spaced along at least one rear circumferential curve concentric to said axis of rotation; are oriented at an obtuse angle of approximately 150 degrees through said nozzle body relative to the orientation of said axis of rotation, thereby causing said forward thrusting force to substantial cancel said rearward thrusting force; and when projected onto a plane of rotation normal to the axis of rotation, are further oriented at a substantially non-normal angle with respect to geometric radii originating at the axis of rotation and extending radially-outward through said plane of rotation, further causing said nozzle to rotate in the same direction as is caused by the middle-positioned ports, while causing said centrifugal forces to be substantially cancelled by virtue of the substantially-equal spacing of the rearward-located ports along said at least one rear circumferential curve.

7. A nozzle body for stabilizing a delivery opening of a hose while said hose delivers liquid under pressure to a delivery location, and when said nozzle body is attached to said hose in a manner leaving it free to rotate about an axis of rotation running through, parallel to, and oriented in the same direction as the liquid flow through said hose, comprising a plurality of nozzle ports enabling said liquid to pass through said nozzle body and be sprayed to said delivery location; said nozzle ports further comprising:

rotation-inducing and centripetally-stabilizing nozzle port means causing said nozzle body to rotate about said axis of rotation, and further causing a centripetal stabilizing force to be applied to the rotation of said nozzle body, inward toward said axis of rotation, in reaction to the flow of said liquid out of said rotation-inducing and centripetally-stabilizing nozzle port means, thereby substantially cancelling centrifugal forces generated by said liquid flow out of said rotation-inducing and centripetally-stabilizing nozzle port means;

thrust-inducing nozzle port means causing a rearward thrusting force to be applied to said nozzle body in reaction to the flow of liquid out of said thrust-inducing nozzle port means; and thrust-cancelling nozzle port means causing a forward thrusting force to be applied to said nozzle body in reaction to the flow of liquid out of said thrust-cancelling nozzle port means, with such magnitude so as to substantially cancel said rearward thrusting force; wherein said thrust-inducing nozzle port means further provides gyroscopic precession cancellation means for opposing and substantially cancelling gyroscopic precession induced by the rotation of said nozzle body; whereby all of the physical thrust, centrifugal and gyroscopic precessional forces due to the passage of said liquid through said hose and nozzle body substantially cancel one another, resulting in no net translational, centrifugal and gyroscopic precessional forces acting upon the nozzle body.

8. The nozzle body of claim 7, wherein said liquid is delivered to said delivery location by aiming said nozzle body at said delivery location over a distance from said delivery location.

9. The nozzle body of claim 7, wherein said liquid is delivered to said delivery location using launching means to launch said nozzle body and said hose attached thereto to said delivery location.

10. The nozzle body of claim 7 wherein said hose is a standard fire hose; wherein said liquid is delivered to the location of, and for the purpose of extinguishing, a fire.

11. The nozzle body of claim 7, wherein said nozzle body comprises a paraboloid shape and is made from a material that is hard and durable to prolong useful life, that is sufficiently dense to provide a suitable moment of inertia, and that suitably enables said liquid to be emitted from said ports established on said nozzle body.

12. The nozzle body of claim 7, wherein:

said thrust-inducing nozzle port means are positioned upon the nozzle body nearest a forward region of said nozzle body and are substantially-equally spaced along at least one forward circumferential curve concentric to said axis of rotation; are oriented at an acute angle of approximately 30 degrees through said nozzle body relative to the orientation of said axis of rotation, thereby causing said rearward thrusting force; and when projected onto a plane of rotation normal to the axis of rotation, are further oriented at an angle of approximately zero degrees with respect to geometric radii originating at the axis of rotation and extending radially-outward through said plane of rotation, thereby opposing and substantially cancelling said gyroscopic precession; wherein said rotation-inducing and centripetally-stabilizing nozzle port means are positioned approximately upon a middle region of the nozzle body and are substantially-equally spaced along at least one middle circumferential curve concentric to said axis of rotation; are oriented at an angle of approximately 90 degrees through said nozzle body relative to the orientation of said axis of rotation thereby not substantially contributing a net thrust along said axis of rotation; and when projected onto a plane of rotation normal to the axis of rotation, are further oriented at a substantially non-normal angle with respect to geometric radii originating at the axis of rotation and extending radially-outward through said plane of rotation, causing said nozzle to rotate about the axis of rotation while causing said centrifugal forces to be substantially cancelled by virtue of the substantially-equal spacing of said ports along said at least one middle circumferential curve; wherein said thrust-cancelling nozzle port means are positioned upon the nozzle body nearest a rear region of said nozzle body and are substantially-equally spaced along at least one rear circumferential curve concentric to said axis of rotation; are oriented at an obtuse angle of approximately 150 degrees through said nozzle body relative to the orientation of said axis of rotation, thereby causing said forward thrusting force to substantial cancel said rearward thrusting force; and when projected onto a plane of rotation normal to the axis of rotation, are further oriented at a substantially non-normal angle with respect to geometric radii originating at the axis of rotation and extending radially-outward through said plane of rotation, further causing said nozzle to rotate in the same direction as is caused by the middle-positioned ports, while causing said centrifugal forces to be substantially cancelled by virtue of the substantially-equal spacing of the rearward-located ports alone said at least one rear circumferential curve.

13. A method for stabilizing a delivery opening of a hose while said hose delivers a flow of liquid under pressure to a delivery location, comprising the steps of:

attaching a nozzle body comprising a plurality of nozzle ports to said delivery opening of said hose with rotational coupling bearing means enabling said nozzle body to rotate about a geometric axis of rotation running through, parallel to, and oriented in the same direction as, the liquid flow;

spraying said delivery location with said liquid by passing said liquid through said nozzle ports in said nozzle body; said nozzle ports further comprising:

rotation-inducing and centripetally-stabilizing nozzle port means rotating said nozzle body about said axis of rotation, and further centripetally stabilizing the rotation of said nozzle body, in reaction to the flow of said liquid out of said rotation-inducing and centripetally-stabilizing nozzle port means;

thrust-inducing nozzle port means inducing a rearward thrusting force to be applied to said nozzle body in reaction to the flow of liquid out of said thrust-inducing nozzle port means; and thrust-cancelling nozzle port means inducing a forward thrusting force to be applied to said nozzle body in reaction to the flow of liquid out of said thrust-cancelling nozzle port means, with such magnitude so as to substantially cancel said rearward thrusting force; wherein said thrust-inducing nozzle port means further provide gyroscopic precession cancellation means in reaction to the flow of liquid out of said nozzle thrust-inducing nozzle port means, for opposing and substantially cancelling gyroscopic precession induced by the rotation of said nozzle body; whereby all of the physical thrust, centrifugal and gyroscopic precessional forces due to passing said liquid through said hose and nozzle body substantially cancel one another, resulting in no net translational, centrifugal and gyroscopic precessional forces acting upon the nozzle body.

14. The method of claim 13, further comprising delivering said liquid to said delivery location by aiming said nozzle body at said delivery location over a distance from said delivery location.

15. The method of claim 13, further comprising delivering of said liquid to said delivery location using launching means to launch said nozzle body and said hose attached thereto to said delivery location.

16. The method of claim 13 wherein said hose is a standard fire hose, and wherein said liquid is delivered to the location of, and for the purpose of extinguishing a fire.

17. The method of claim 13, said nozzle body comprising a paraboloid shape, and being made from a material that is hard and durable to prolong useful life, that is sufficiently dense to provide a suitable moment of inertia, and that suitably enables said liquid to be emitted from said ports established on said nozzle body.

18. The method of claim 13, wherein:

said thrust-inducing nozzle port means are positioned upon the nozzle body nearest a forward region of said nozzle body and are substantially-equally spaced along at least one forward circumferential curve concentric to said axis of rotation; are oriented at an acute angle of approximately 30 degrees through said nozzle body relative to the orientation of said axis of rotation, thereby causing said rearward thrusting force; and when projected onto a plane of rotation normal to the axis of rotation, are further oriented at an angle of approximately zero degrees with respect to geometric radii originating at the axis of rotation and extending radially-outward through said plane of rotation, thereby opposing and substantially cancelling said gyroscopic precession; wherein said rotation-inducing and centripetally-stabilizing nozzle port means are positioned approximately upon a middle region of the nozzle body and are substantially-equally spaced along at least one middle circumferential curve concentric to said axis of rotation; are oriented at an angle of approximately 90 degrees through said nozzle body relative to the orientation of said axis of rotation thereby not substantially contributing a net thrust along said axis of rotation; and when projected onto a plane of rotation normal to the axis of rotation, are further oriented at a substantially non-normal angle with respect to geometric radii originating at the axis of rotation and extending radially-outward through said plane of rotation, causing said nozzle to rotate about the axis of rotation while causing said centrifugal forces to be substantially cancelled by virtue of the substantially-equal spacing of said ports along said at least one middle circumferential curve; wherein said thrust-cancelling nozzle port means are positioned upon the nozzle body nearest a rear region of said nozzle body and are substantially-equally spaced along at least one rear circumferential curve concentric to said axis of rotation; are oriented at an obtuse angle of approximately 150 degrees through said nozzle body relative to the orientation of said axis of rotation, thereby causing said forward thrusting force to substantial cancel said rearward thrusting force; and when projected onto a plane of rotation normal to the axis of rotation, are further oriented at a substantially non-normal angle with respect to geometric radii originating at the axis of rotation and extending radially-outward through said plane of rotation, further causing said nozzle to rotate in the same direction as is caused by the middle-positioned ports, while causing said centrifugal forces to be substantially cancelled by virtue of the substantially-equal spacing of the rearward-located ports along said at least one rear circumferential curve.

19. A rotary nozzle comprising a plurality of nozzle ports, wherein the location and orientation of said nozzle ports, in combination, and in reaction to a flow of liquid through said ports, provide means to:

rotate said nozzle body about an axis of rotation;

centripetally stabilize the rotation of said nozzle body;

induce a rearward thrusting force upon said nozzle body;

induce a forward thrusting force upon said nozzle body substantially cancelling said rearward thrusting force; and induce a gyroscopic precession cancellation force opposing and substantially cancelling gyroscopic precession caused by the rotation of said nozzle body.

20. A method of stabilizing a firehose while fighting a fire and thereby supplanting the need for firefighting personnel to be present to stabilize said firehose, comprising the steps of:

attaching a rotating nozzle body comprising a plurality of nozzle ports to said firehose, with rotational attachment means, enabling said nozzle body to rotate about a geometric axis of rotation running through, parallel to, and oriented in the same direction as, a liquid flow through said firehose; and spraying said liquid at said fire by passing said liquid from said firehose into said nozzle body and through said nozzle ports;

the location and orientation of said nozzle ports, in combination, and in reaction to the flow of said liquid through said ports, further providing means for:

rotating said nozzle body about said axis of rotation;

centripetally stabilizing the rotation of said nozzle body;

inducing a rearward thrusting force upon said nozzle body; and inducing a forward thrusting force upon said nozzle body substantially cancelling said rearward thrusting force.

21. The method of claim 20, the location and orientation of said nozzle ports, in combination, and in reaction to the flow of said liquid through said ports, further providing means for inducing a gyroscopic precession cancellation force opposing and substantially cancelling gyroscopic precession caused by the rotation of said nozzle body.

* * * * *